US008684769B2

(12) United States Patent
Kao et al.

(10) Patent No.: US 8,684,769 B2
(45) Date of Patent: Apr. 1, 2014

(54) ELECTRICAL CONNECTOR HAVING TERMINAL PORTIONS IN SPECIFIC ARRANGEMENT AND A GROUNDING PLATE FOR EXCELLENT HIGH-FREQUENCY CHARACTERISTICS

(75) Inventors: Chien-Ping Kao, Hershey, PA (US); Terrance F. Little, Fullerton, CA (US); An-Jen Yang, Irvine, CA (US); Duong Phan, Westminister, CA (US); Kuo-Chun Hsu, New Taipei (TW); Ming-Chuan Wu, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 72 days.

(21) Appl. No.: 13/479,289

(22) Filed: May 24, 2012

(65) Prior Publication Data

US 2013/0316581 A1 Nov. 28, 2013

(51) Int. Cl.
*H01R 13/648* (2006.01)

(52) U.S. Cl.
USPC ..... 439/607.28

(58) Field of Classification Search
USPC ..... 439/607.28, 607.41, 660
See application file for complete search history.

(56) References Cited

U.S. PATENT DOCUMENTS

| | | | | |
|---|---|---|---|---|
| 6,902,432 | B2 * | 6/2005 | Morikawa et al. | 439/607.41 |
| 6,913,485 | B2 * | 7/2005 | Ko | 439/579 |
| 7,223,915 | B2 * | 5/2007 | Hackman | 174/36 |
| 7,255,607 | B1 * | 8/2007 | Wu | 439/660 |
| 7,559,802 | B2 * | 7/2009 | Hu et al. | 439/607.41 |
| 7,618,293 | B2 * | 11/2009 | Wu | 439/660 |
| 7,708,600 | B2 * | 5/2010 | Wu | 439/660 |
| 7,744,426 | B2 * | 6/2010 | Zheng et al. | 439/660 |
| 7,837,510 | B1 * | 11/2010 | Hung et al. | 439/660 |
| 8,070,529 | B2 * | 12/2011 | Xiong et al. | 439/676 |
| 8,079,854 | B2 * | 12/2011 | He et al. | 439/108 |
| 8,109,795 | B2 * | 2/2012 | Lin et al. | 439/660 |
| 8,152,566 | B1 * | 4/2012 | Little et al. | 439/607.41 |
| 8,323,057 | B2 * | 12/2012 | Ho | 439/660 |
| 8,439,708 | B2 * | 5/2013 | Colantuono et al. | 439/660 |
| 2010/0267261 | A1 * | 10/2010 | Lin et al. | 439/218 |

* cited by examiner

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

A first connector includes a first insulative housing defining opposite first and second mating faces, a set of first upper contacts arranged upon the first mating face, a set of first lower contacts including a first lower differential pairs, a second lower differential pairs and a lower grounding contact, and a first grounding plate. The contacting sections and the first grounding arm are arranged upon the second mating face, and the first terminal portions of the first lower differential pairs are arranged in a first row, and the second terminal portions of the second lower differential pairs and the tail section of the lower grounding contact are arranged in a second row for excellent high-frequency characteristics.

20 Claims, 12 Drawing Sheets

ELECTRICAL CONNECTOR HAVING TERMINAL PORTIONS IN SPECIFIC ARRANGEMENT AND A GROUNDING PLATE FOR EXCELLENT HIGH-FREQUENCY CHARACTERISTICS

FIELD OF THE INVENTION

The present invention relates generally to an electrical connector, and more particularly to an electrical connector suitable for high-speed differential signal transmission having terminal portions in specific arrangement and a grounding plate for excellent high-frequency characteristics.

DESCRIPTION OF THE RELATED ART

A connector capable of transmitting high-speed differential signals is used as an interface connector or an internal connector of a digital appliance or a PC. Such connector includes a plurality of signal contacts and a plurality of ground contacts. The signal contacts are paired in order to transmit differential signals in the manner known in the art. Generally, on the side of a fitting portion or a contacting portion side of the connector is fitted to or contacted with a mating connector. On the other hand, on the terminal portion side of the contacts to be connected to a board, the terminal portions are arranged in a plurality of rows because the terminal portions are inserted into a plurality of through holes, respectively.

At present, transmission of high-speed differential signals is required in a growing number of software applications. Under the circumstances, there is a demand for an improved connector having a compact size, a low piece, and excellent high-frequency characteristics.

SUMMARY OF THE INVENTION

Accordingly, an object of the present invention is to provide an electrical connector having terminal portions in specific arrangement and a grounding plate for excellent high-frequency characteristics.

In order to achieve the object set forth, a first connector includes a first insulative housing defining a base member and a mating member extending forwardly from the base member in a mating direction and having opposite first and second mating faces in a vertical direction perpendicular to said mating direction, a set of first upper contacts retained in the first housing and including an upper differential pairs and two upper grounding contacts located at two opposite sides of the upper differential pairs to be arranged upon the first mating face in a longitudinal direction, a set of first lower contacts retained in the first housing and including a first lower differential pairs, a second lower differential pairs and a lower grounding contact, and a first grounding plate retained in the first housing and disposed between the set of first upper contacts and the set of first lower contacts. The first lower differential pairs each defines a first terminal portion and a first contacting section, the second lower differential pairs each defines a second terminal portion and a second contacting section, and the lower grounding contact defines a tail section and a first grounding arm, the first contacting sections, the second contacting sections and the first grounding arm are arranged upon the second mating face in the longitudinal direction under a condition that the two first contacting sections and the two second contacting sections are respectively disposed at two opposite sides of the first grounding arm, and the first terminal portions are arranged in a first row, and the second terminal portions and the tail section are arranged in a second row.

Other objects, advantages and novel features of the invention will become more apparent from the following detailed description of the present embodiment when taken in conjunction with the accompanying drawings.

DETAILED DESCRIPTION OF THE INVENTION

Figure 1:
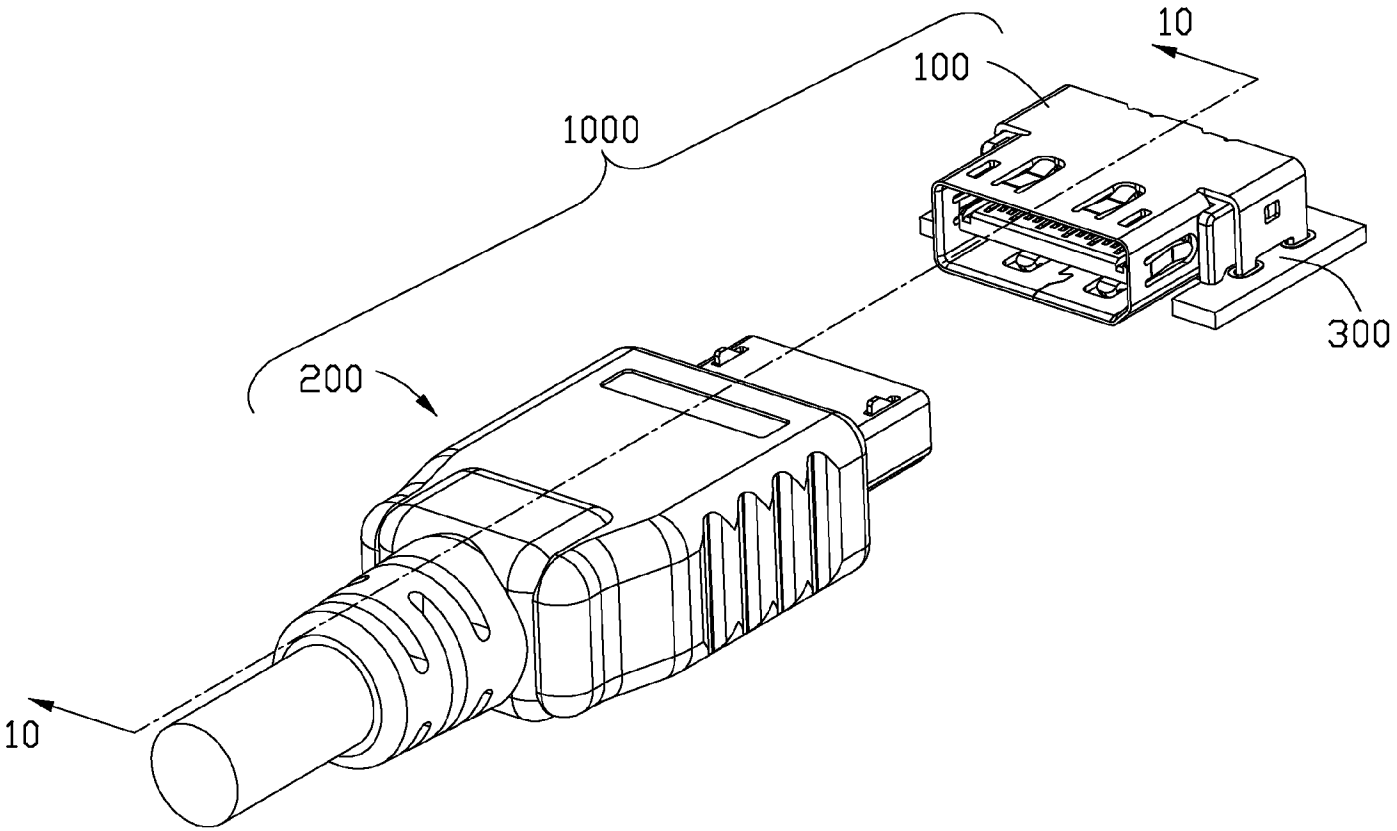
FIG. 1 is an assembled, perspective view of an electrical connector assembly including first and second connectors in accordance with the present invention.

Reference will now be made to the drawing figures to describe a preferred embodiment of the present invention in detail.

Figure 2:
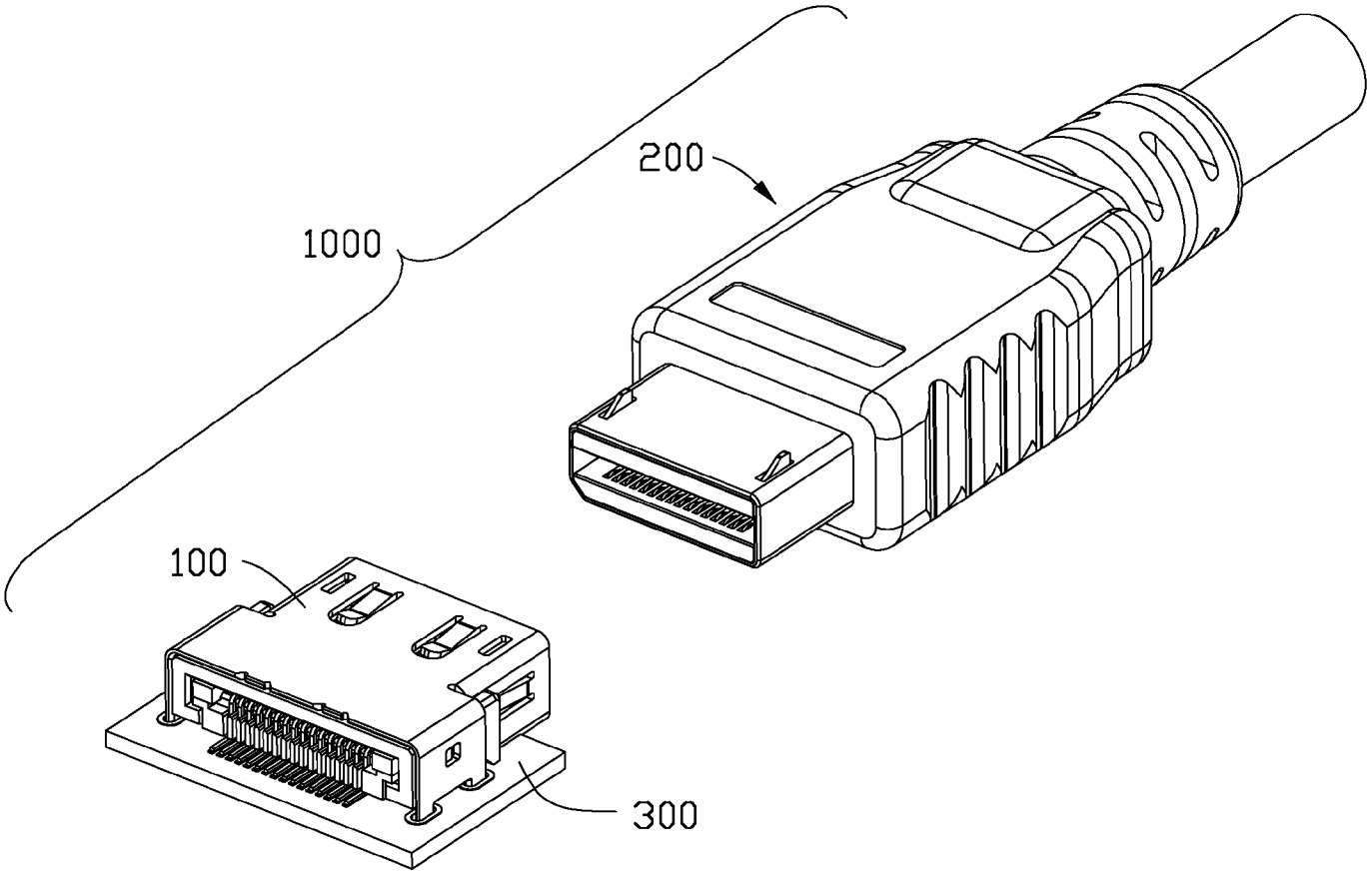
FIG. 2 is another perspective view of the electrical connector assembly shown in FIG. 1.

Referring to FIGS. 1 and 2, an electrical connector assembly 1000 in accordance with the present invention includes a first connector 100 to be mounted onto a printed circuit board 300 and a second connector 200 mating with the first connector 100.

Figure 3:
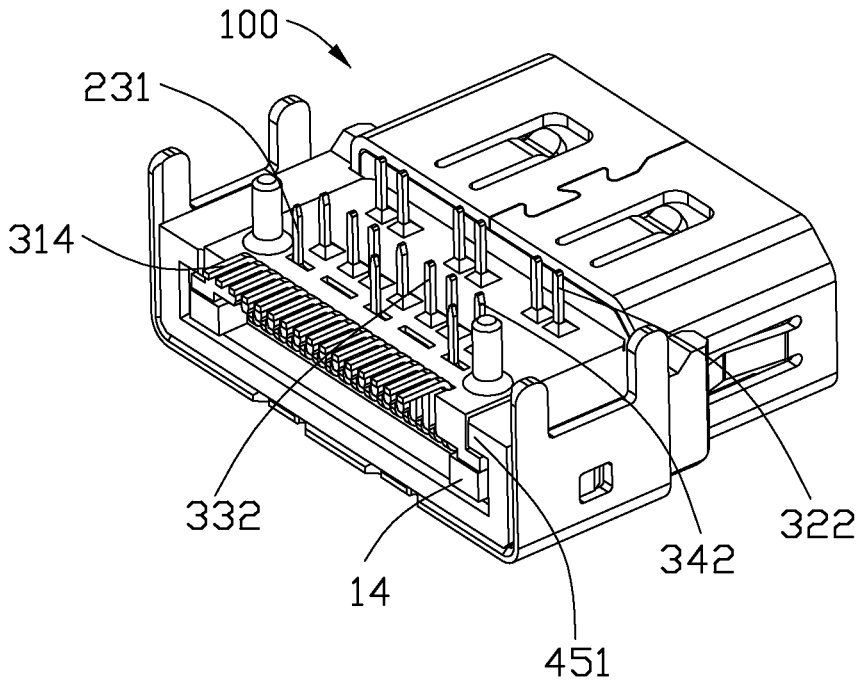
FIG. 3 is an assembled, perspective view of the first connector shown in FIG. 1.
Figure 4:
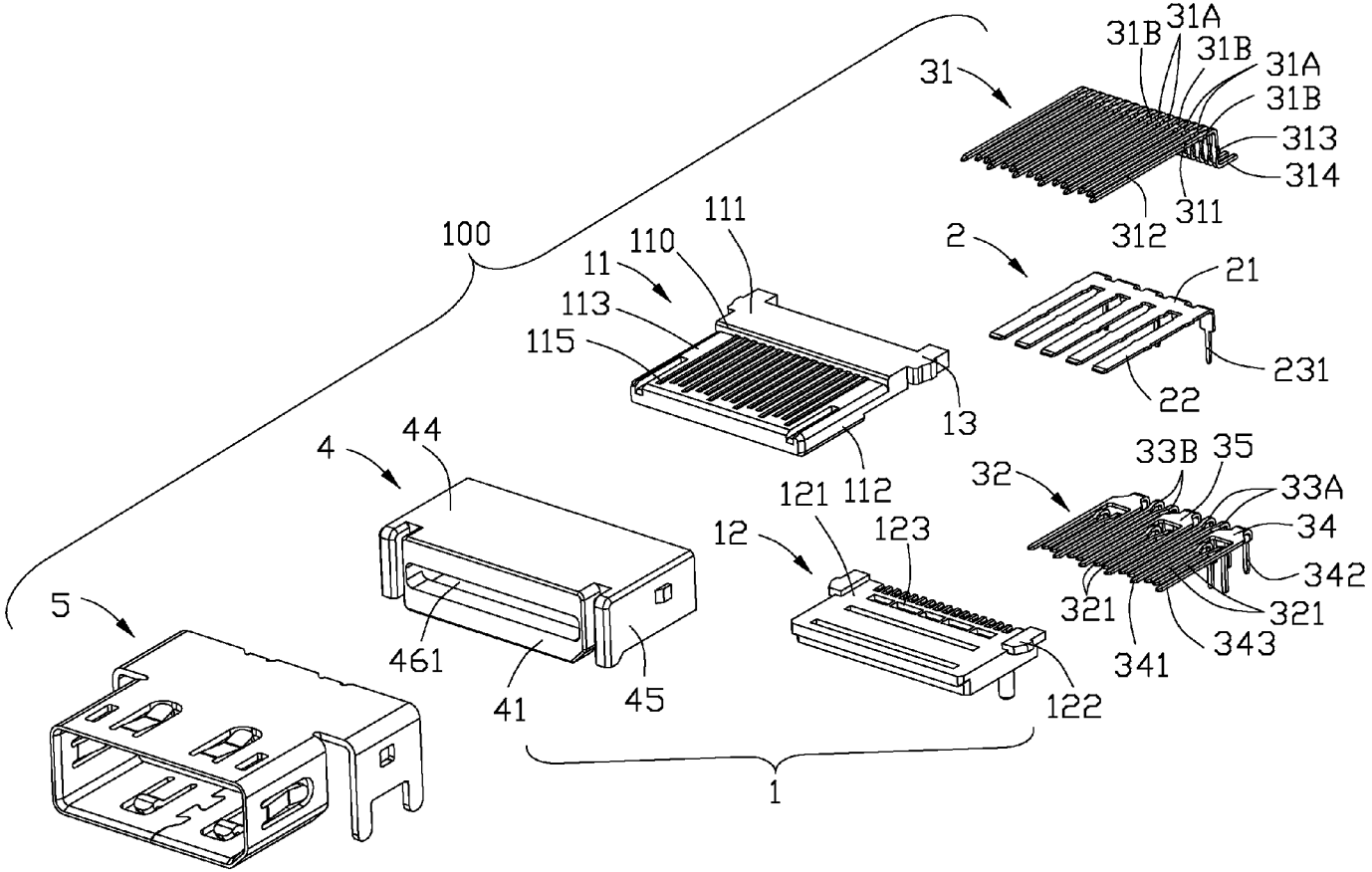
FIG. 4 is an exploded view of the first connector shown in FIG. 1.
Figure 5:
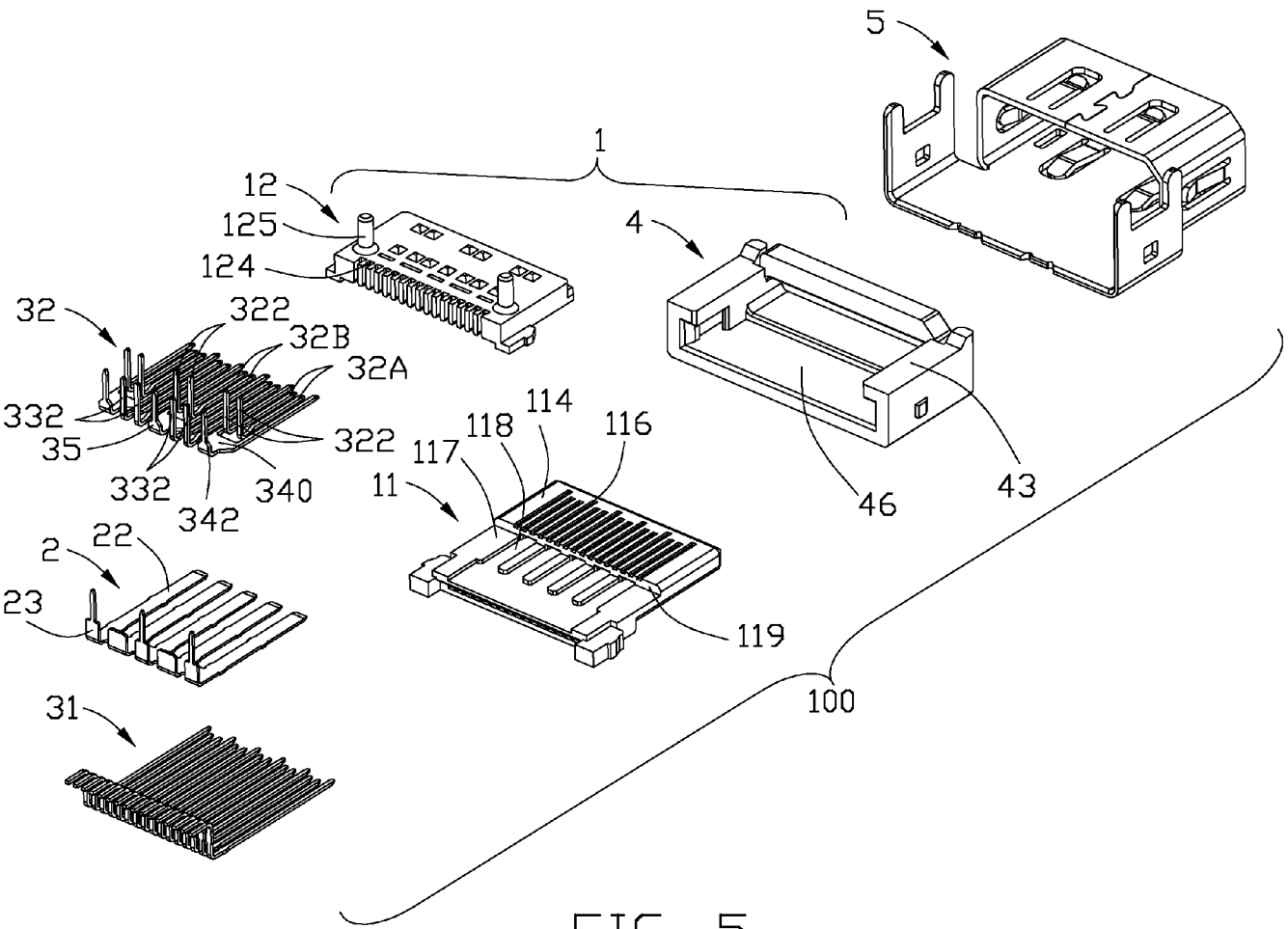
FIG. 5 is another exploded view of the first connector shown in FIG. 4.
Figure 6:
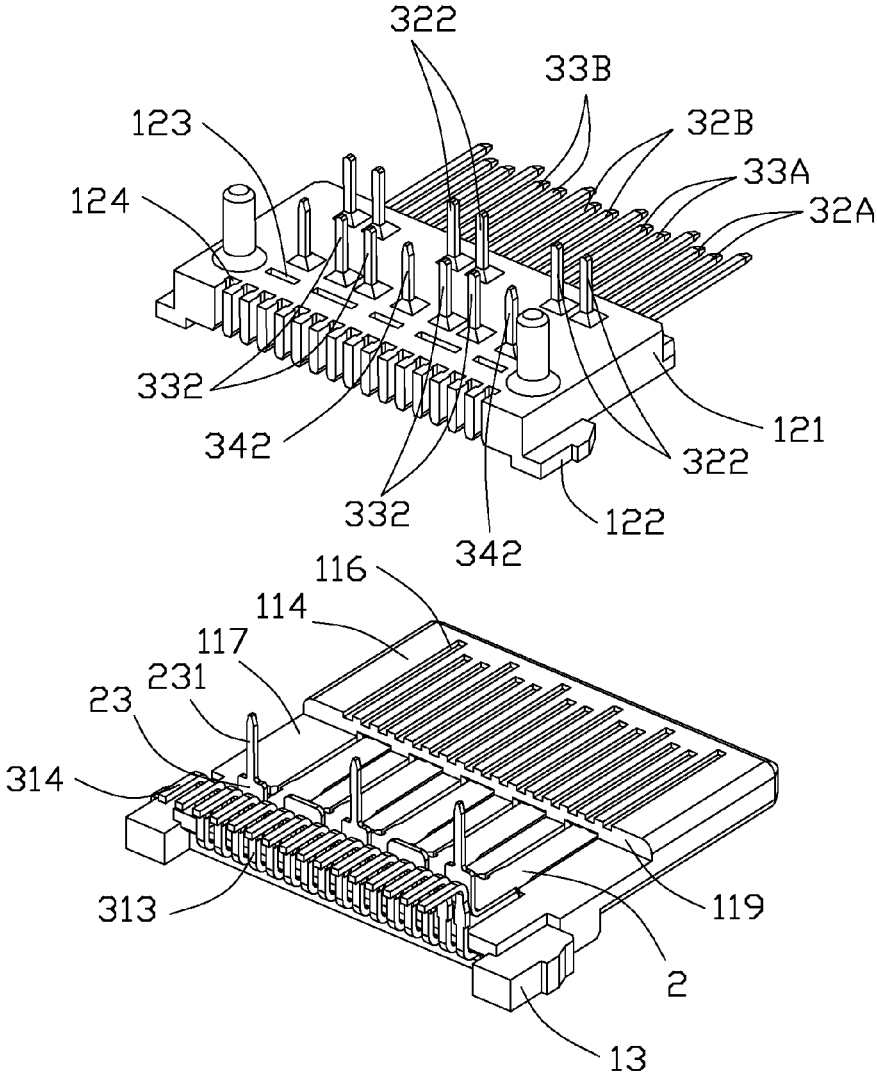
FIG. 6 is an exploded view of an upper member and a lower member of the first connector shown in FIG. 1 with a plurality of first contacts retained therein.
Figure 7:
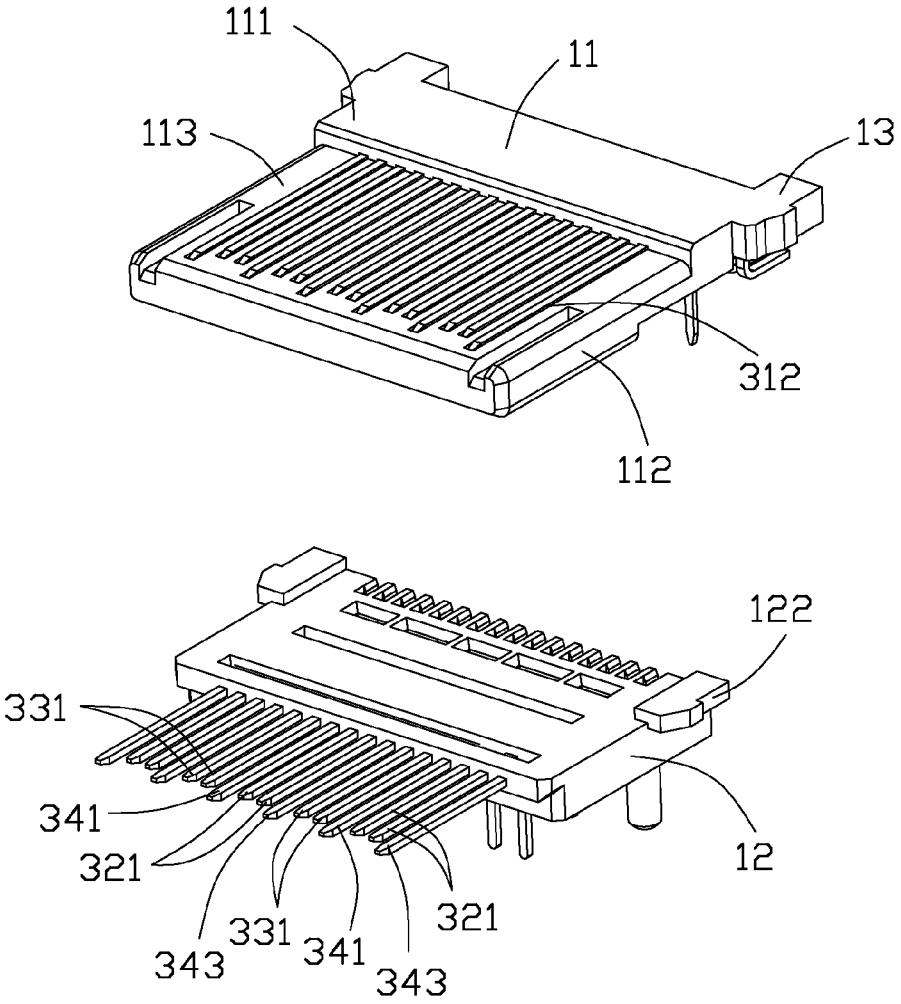
FIG. 7 is another exploded view of the upper member and the lower member shown in FIG. 6.
Figure 8:
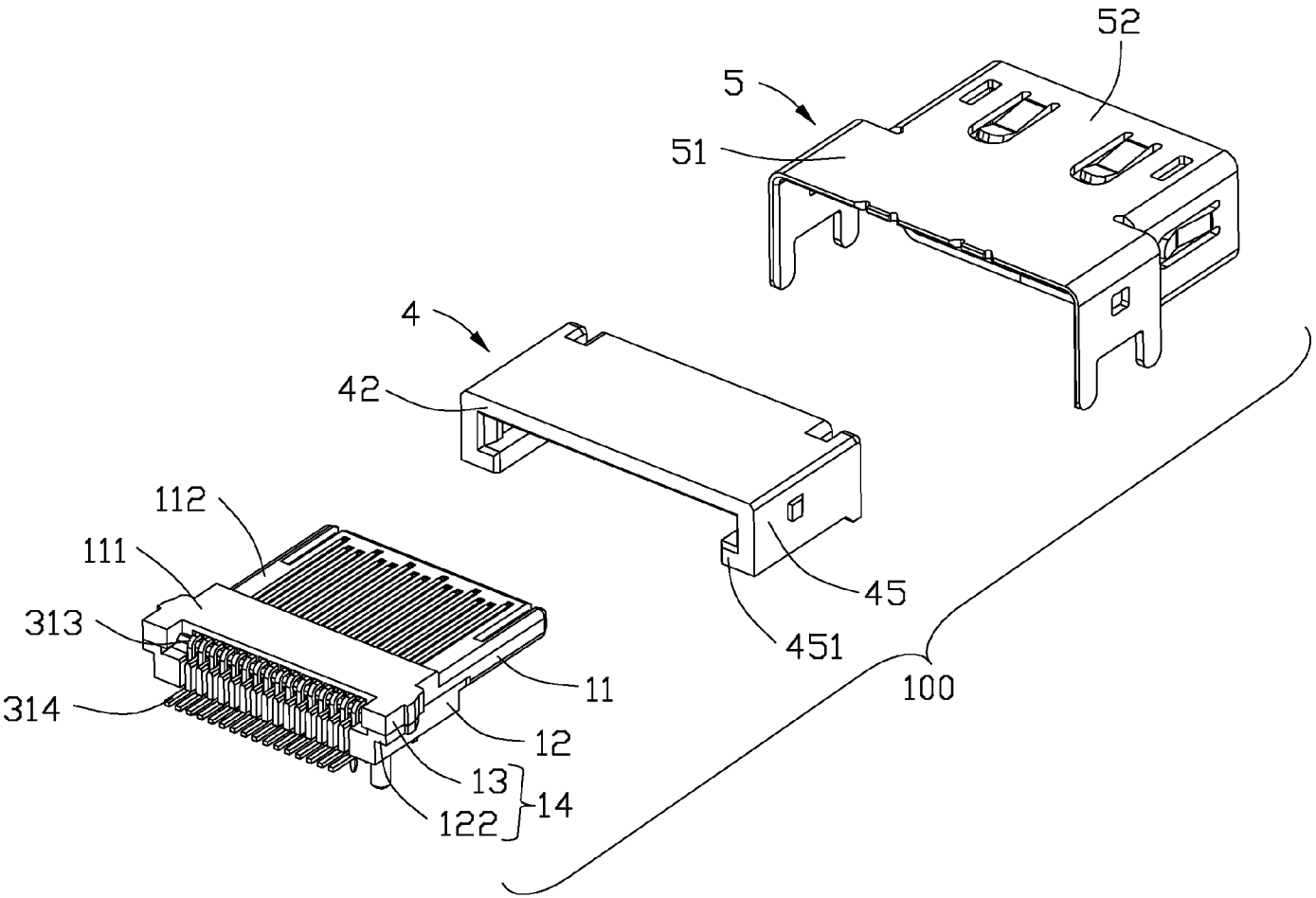
FIG. 8 is a partly exploded perspective view of the first connector and shows an insulative bracket and a metal shell separated from the upper member and the lower member shown in FIG. 1.
Figure 9:
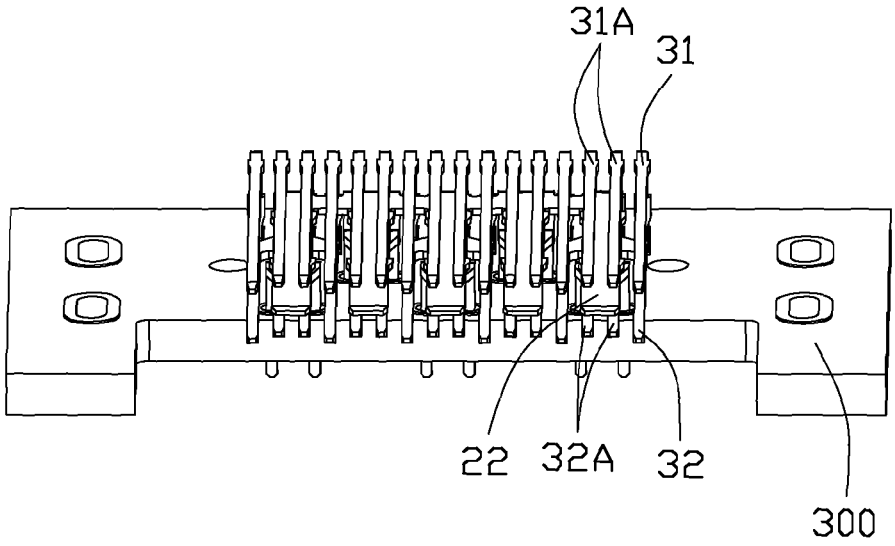
FIG. 9 is a perspective view of the first contacts and a grounding plate retained to a printed circuit board and shows arrangement of the contacting portions.

Referring to FIGS. 3 to 5, the first connector 100 mainly includes a first insulative housing 1, a first grounding plate 2 retained in the first housing 1, a plurality of first contacts retained in the first housing 1 and disposed at two opposite sides of the first grounding plate 2, and a metal shell 5 surrounding the first housing 1.

The first housing 1 includes an upper member 11, a lower member 12 engaging with the upper member 11 and an insulative bracket 4 retained to the upper and lower members 11, 12. The upper member 11 defines a first base portion 111 and a mating portion 112 extending forward from the first base portion 111 with a stopping face 110 formed therebetween, the first base portion 111 defines two protrusions 13 rearward and outwardly extending from opposite two rear sides thereof, the mating portion 112 defines opposite first mating face 113 and second mating face 114. A plurality of first receiving slots 115 is disposed upon the first mating face 113 and further run through the first base portion 111 in a mating direction, a plurality of second receiving slots 116 is disposed upon the second mating face 114 at a front portion thereof. The upper member 11 defines a receiving room 117 at a rear portion to be disposed behind the second receiving slots 116 and provides a step portion 119 at the mating portion 112. The receiving room 117 further defines five receiving passages 118 run into the mating portion 112 and disposed between the first mating face 113 and the second mating face 114.

The lower member 12 defines a main body portion 121 and two supporting portions 122 respectively extending outwards from two opposite sides of the main body portion 121 at an upper rear portion thereof, five through holes 123 run through the main body portion 121 in a vertical direction perpendicularly to the mating direction and arranged in a longitudinal direction. The main body portion 121 further defines a plurality of retaining slots 124 recessed from a rear face thereof and two retaining posts 125 extending downwardly from two outer sides of a bottom face thereof.

Referring to FIGS. 3 to 7, the first grounding plate 2 defines a board-shaped first base plate 21, five first shielding arms 22 extending forward from a front end of the first base plate 21, and five connecting portions 23 corresponding to the five first shielding arms 22 bending downwardly from a rear end of the first base plate 21. Three connecting legs 231 extend downwardly respectively from the first, third and fifth shielding arms 22. The five first shielding arms 22 are disposed at a same plane. The first grounding plate 2 is received in the receiving room 117 with the first shielding arms 22 forwardly inserted into the corresponding receiving passages 118 and disposed between the first and second mating faces 113, 114.

The plurality of first contacts includes a set of first upper contacts 31 and a set of first lower contacts 32. The set of first upper contacts 31 includes four pairs of upper differential pairs 31A for signal transmission and five upper grounding contacts 31B located at two opposite sides of the upper differential pairs 31A. The upper differential pairs 31A and the upper grounding contacts 31B have similar configuration and each includes an upper retention section 311, an upper blade contacting section 312 extending forward from the upper retention section 311, a restricting portion 313 bending downwardly from the upper retention section 311 and a leg section 314 bending rearwards from the restricting portion 313. The upper contacting sections 312 are disposed in a same plane, the leg sections 314 are also disposed in a same plane and arranged in one row, the leg sections 314 provide a mounting surface for mounting onto the printed circuit board 300. The set of upper contacts 31 are forwardly assembled into the first receiving slots 115 with the upper retention sections 311 retained in the upper member 11, the upper contacting sections 312 expose upon the first mating face 113, the restricting portions 313 are disposed behind the connecting portions 23.

The set of first lower contacts 32 includes four pairs of lower differential pairs 32A, 33A, 32B and 33B arranged in a longitudinal direction for signal transmission and first and second lower grounding contacts 34, 35 having similar configuration, the set of lower contacts 32 are inserted molding in the lower member 12. The first lower differential pairs 32A and the third lower differential pairs 32B have similar configuration, the second lower differential pairs 33A and the fourth lower differential pairs 33B have similar configuration. The first or third lower differential pairs 32A or 32B each defines a first terminal portion 322 and a first contacting section 321, the second or fourth lower differential pairs 33A or 33B each defines a second terminal portion 332 and a second contacting section 331. Each lower grounding contact 34/35 defines a base plate 340, a tail section 342 bending downwardly from a rear end of the base plate 340, and two grounding arms 341, 343 extending forwardly from two opposite sides of a front end of the base plate 340. The first contacting sections 321, the second contacting sections 331, and the first and second grounding arms 341, 343 are disposed in a same plane and arranged in one row with one grounding arm 341/343 disposed between every adjacent two lower differential pairs.

In this embodiment, the two first contacting sections 321 of the first lower differential pairs 32A and the two second contacting sections 331 of the second lower differential pairs 33A are respectively disposed at two opposite sides of a first grounding arm 341 of the first lower grounding contact 34, the two first contacting sections 321 of the third lower differential pairs 32B and the two second contacting sections 331 of the second lower differential pairs 33A are respectively disposed at two opposite sides of a second grounding arm 343 of the second grounding contact 35, the two first contacting sections 321 of the third lower differential pairs 32B and the two second contacting sections 331 of the fourth lower differential pairs 33B are respectively disposed at two opposite sides of a first grounding arm 341 of the second grounding contact 35. The first and second grounding arms 341, 343 of the first lower grounding contact 34 are disposed at two outmost of the first contacting sections 321 of the first lower differential pairs 32A, and the first and second grounding arms 341, 343 of the second lower grounding contact 35 are disposed at two outmost of the first contacting sections 321 of the third lower differential pairs 32B. The first terminal portions 322, the second terminal portions 332, and the tail sections 342 are arranged in two rows under a condition that the first terminal portions 322 of the first and third lower differential pairs 32A, 32B are arranged in a first row, and the second terminal portions 332 of the second and fourth lower differential pairs 33A, 33B and the tail sections 342 of the first and second lower grounding contacts 34, 35 are arranged in a second row. The tail sections 342 of the first and second grounding contacts 34, 35 are disposed at two outmost of the second terminal portions 332 of the second lower differential pairs 33A. The first and second terminal portions 322, 332 and the tail sections 342 in specific arrangement may provide excellent high-frequency characteristics of the first connector 100.

Referring to FIGS. 6 to 10, the lower member 12 retaining the set of lower contacts 32 is upwardly assembled to the upper member 11. The main body portion 121 is received in the receiving room 117 and abuts against the step portion 119, and the supporting portions 122 upwardly abut against the protrusions 13 to be defined as hooking portions 14. The first contacting sections 321, the second contacting sections 331, and the first and second grounding arms 341, 343 are received in corresponding second receiving slots 116 and expose upon the second mating face 114. The connecting portions 23 are received in the through holes 123 with the connecting legs 231 running therethrough, the restricting portions 313 retained in the retaining slots 124, and the leg sections 314 located behind the connecting legs 231 and arranged in a third row. The first grounding plate 2 is disposed between the set of first upper contacts 31 and the set of first lower contacts 32 with each first shielding arm 22 disposed between a upper differential pairs 31A of the first upper contacts 31 and a lower differential pairs 32A, 33A, 32B or 33B of the first lower contacts 32 for improved impedance.

Referring to FIG. 3 to FIG. 10, the bracket 4 defines a front face 41, a rear face 42 opposite to the front face 41, a bottom face 43 defined as a fixing face, a top face 44 facing to the bottom face 43, and a pair of sidewalls 45 connecting with the bottom and top faces 43, 44. A receiving portion 46 is recessed rearwards from the front face 411 to run through the rear face 42 and a rear portion of the bottom face 43, and the receiving portion 46 provides an opening 461 at the front face 41 thereof. The sidewalls 45 each defines a platform 451 extending towards the receiving portion 46 from an inner face of the sidewall 45. The upper member 11 assembled with the lower member 12 is inserted into the receiving portion 46 from the rear face 42 of the bracket 4 and retained in the receiving portion 46 by the hooking portions 14 supported by the corresponding platforms 451 and locking with the sidewalls 45. The mating portion 112 forwardly extends out of the receiving portion 46 from the opening 461 thereof. The first base portion 111 retaining with the main body portion 121 and the bracket 4 is defined as a base member 15 of the first connector 100, and the mating portion 112 is defined as a mating member 16 of the first connector 100.

The metal shell 5 defines a shielding portion 51 surrounding the bracket 4, and a mating frame 52 connecting with the shielding portion 51. The shell 5 is assembled rearwards from the front face 41 of the bracket 4, the shielding portion 51 surrounds the bracket 4, and the mating member 16 is disposed in the mating frame 52.

Figure 10:
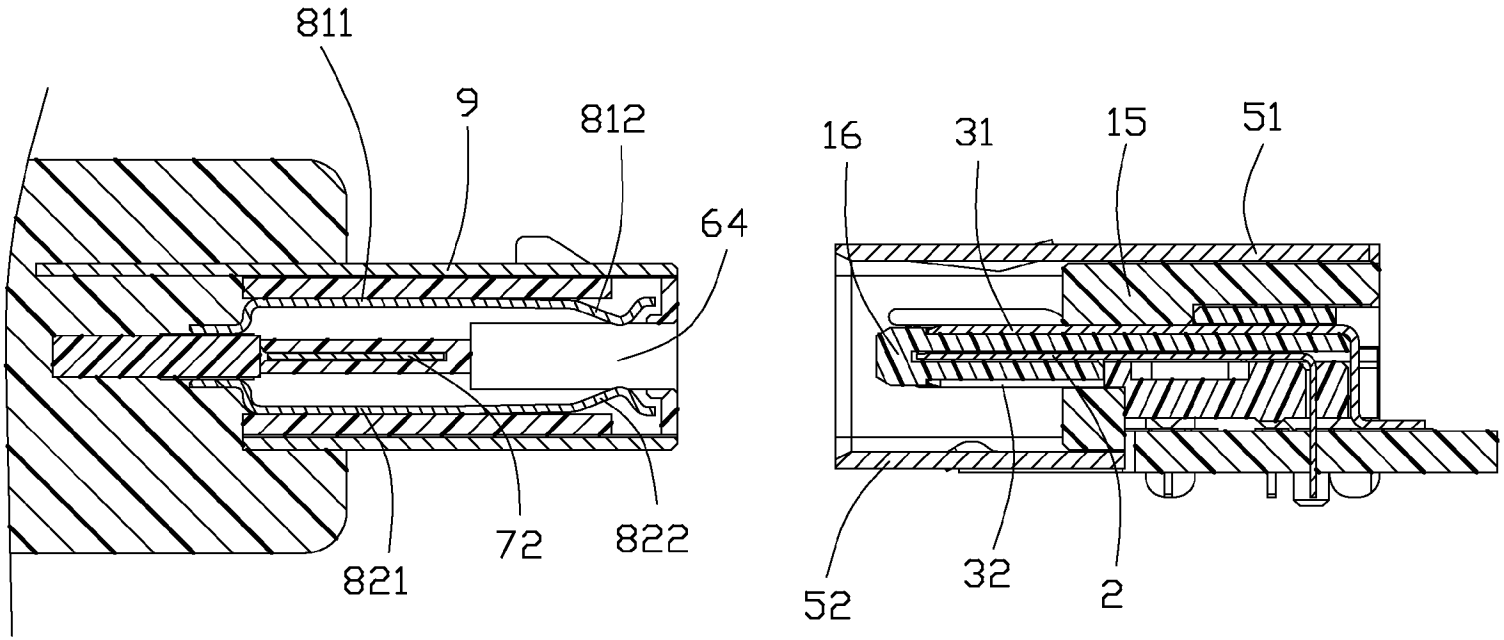
FIG. 10 is a cross-section view of the electrical connector assembly taken along line 10-10 of FIG. 1.
Figure 11:
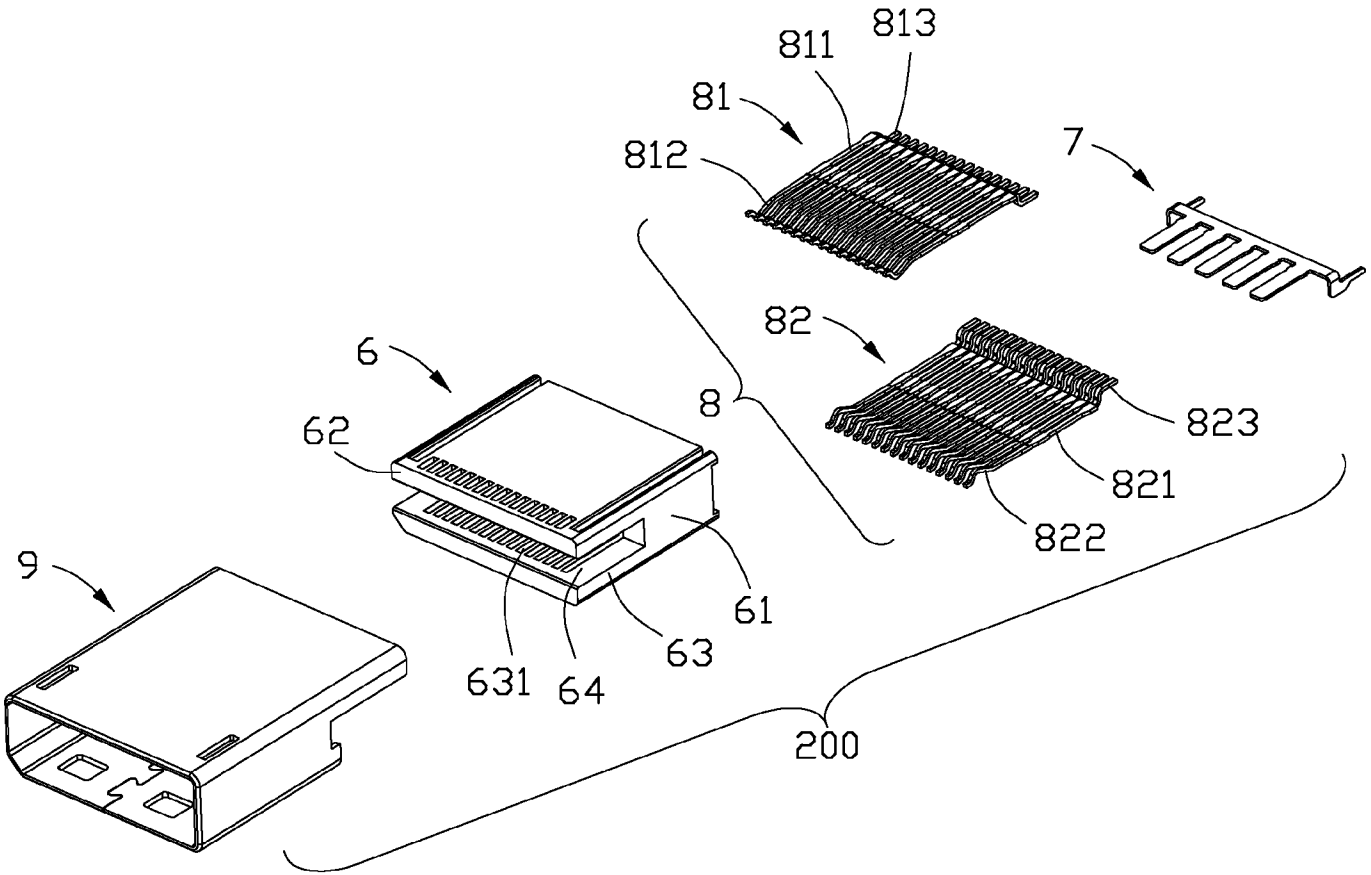
FIG. 11 is an exploded perspective view of the second connector shown in FIG. 1.
Figure 12:
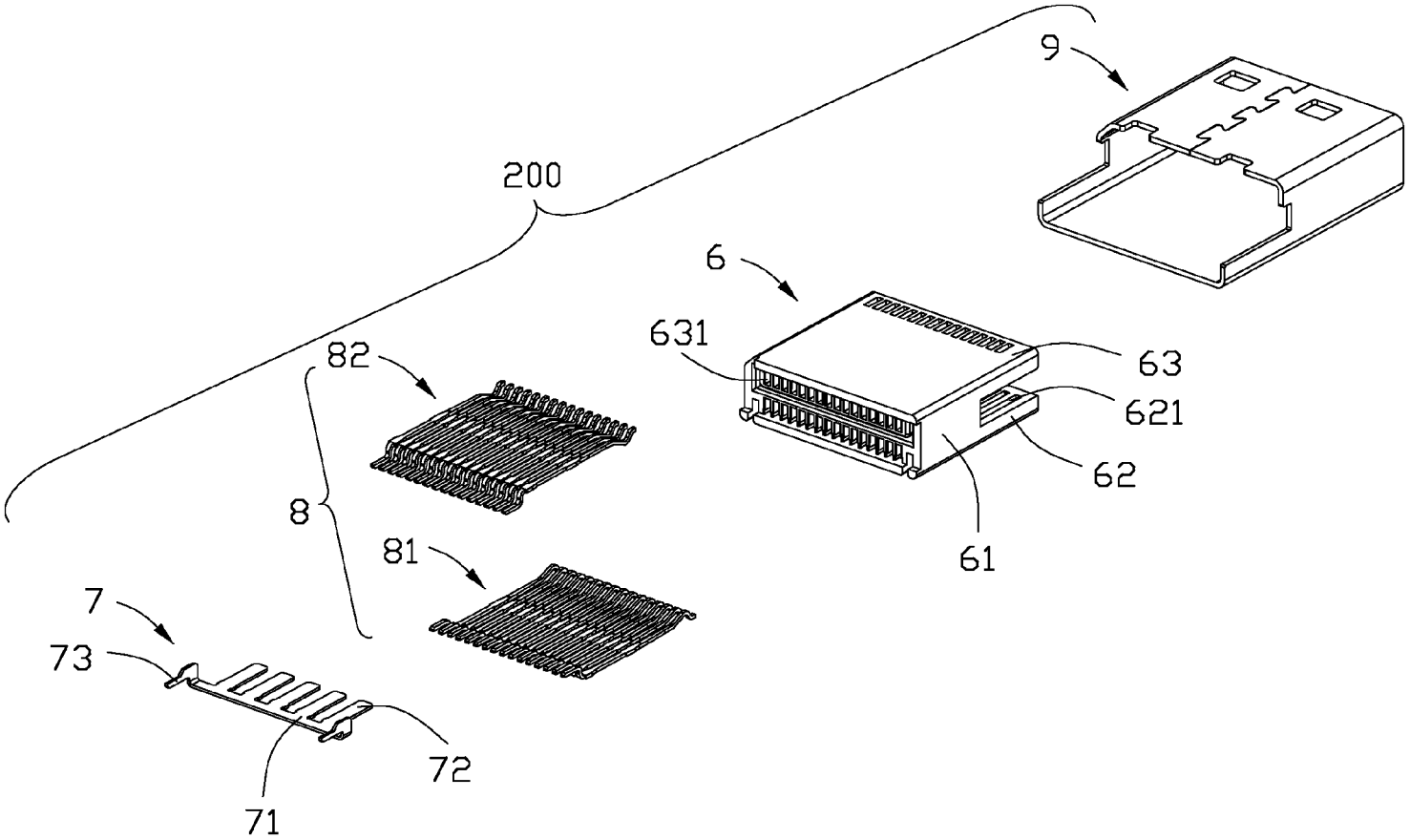
FIG. 12 is another exploded perspective view of the second connector shown in FIG. 11.

Referring to FIG. 10 to FIG. 12, the second connector 200 mainly includes a second insulative housing 6, a second grounding plate 7 retained to the second housing 6, a plurality of second contacts 8 retained to the second housing 6, and a second metal shell 9 shielding the second housing 6.

The second housing 6 defines a second base portion 61, a first tongue portion 62 and a second tongue portion 63 oppositely extending forward from the second base portion 61, and a mating room 64 disposed between the first and second tongue portions 62, 63. The first tongue portion 62 defines a plurality of first receiving grooves 621 communicating with the mating room 64 and further run through the second base portion 61, the second tongue portion 63 defines a plurality of second receiving grooves 631 communicating with the mating room 64 and further run through the second base portion 61.

The second grounding plate 7 defines a second base plate 71, five second shielding arms 72 extending forward from a front end of the second base plate 71, and two soldering portions 73 bending downwardly and extending rearwards from two sides of the second base plate 71. The five second shielding arms 72 is disposed at a same plane. The second grounding plate 7 is insert-molded in the second housing 6 with the soldering portions 73 extending out of the second housing 6.

The plurality of second contacts 8 includes a set of second upper contacts 81 and a set of second lower contacts 82. Each second upper contact defines a first fixing portion 811, a first flexible contacting arm 812 extending forward from the first fixing portion 811 and bending downwardly, and an upper soldering leg 813 bending downwardly and then extending rearward from the first fixing portion 811. Each second lower contacts 82 defines a second fixing portion 821, a second flexible contacting arm 822 extending forward from the second fixing portion 821 and bending upwardly, and a lower soldering leg 823 bending upwardly and then extending rearward from the second fixing portion 821. The plurality of second contacts 8 are assembled to the second housing 6 with the set of second upper contacts 81 retained in the first receiving grooves 621, and the set of second lower contacts 82 retained in the second receiving grooves 631. The first flexible contacting arms 812 and second flexible contacting arms 822 partly project into the mating room 64, the second shielding arms 72 are disposed between the first fixing portions 811 and the second fixing portions 821 for improved impedance. The second shell 9 covers outside of the second housing 6 for shielding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A first connector comprising:

a first insulative housing defining a base member and a mating member extending forwardly from the base member in a mating direction, the mating member defining opposite first and second mating faces in a vertical direction perpendicular to said mating direction;

a set of first upper contacts retained in the first housing and including an upper differential pairs and two upper grounding contacts located at two opposite sides of the upper differential pairs to be arranged upon the first mating face in a longitudinal direction;

a set of first lower contacts retained in the first housing and including a first lower differential pairs, a second lower differential pairs and a lower grounding contact; and a first grounding plate retained in the first housing and disposed between the set of first upper contacts and the set of first lower contacts;

wherein the first lower differential pairs each defines a first terminal portion and a first contacting section, the second lower differential pairs each defines a second terminal portion and a second contacting section, and the lower grounding contact defines a tail section and a first grounding arm, the first contacting sections, the second contacting sections and the first grounding arm are arranged upon the second mating face in the longitudinal direction under a condition that the two first contacting sections and the two second contacting sections are respectively disposed at two opposite sides of the first grounding arm, and the first terminal portions are arranged in a first row, and the second terminal portions and the tail section are arranged in a second row.

2. The first connector as described in claim 1, wherein the lower grounding contact defines a second grounding arm parallel to the first grounding arm, and the two first contacting sections are disposed between the first and second grounding arms.

3. The first connector as described in claim 2, wherein the set of first upper contacts each defines a leg section disposed in a same plane and arranged in a third row located behind the first and second rows.

4. The first connector as described in claim 2, wherein the upper differential pairs each defines an upper contacting section, and the first grounding plate defines a first shielding arm disposed between the two upper grounding contacts in the longitudinal direction and between the upper contacting sections and the first contacting sections in the vertical direction.

5. The first connector as described in claim 4, wherein the first housing defines an upper member providing the opposite first and second mating faces and a lower member engaging with the upper member, and the set of first upper contacts is retained in the upper member, the set of first lower contacts is retained in the lower member.

6. The first connector as described in claim 5, wherein the upper member defines a receiving room at a rear portion thereof, and the lower member is retained in the receiving room.

7. The electrical connector as described in claim 6, wherein the lower member defines a plurality of retaining slots recessed from a rear face thereof, and the set of first upper contacts define restricting portions retained in the corresponding retaining slots.

8. An electrical connector assembly comprising:

a first connector including:

a first insulative housing defining opposite first and second mating faces in a vertical direction;

a set of first upper contacts retained in the first housing arranged upon the first mating face in a longitudinal direction;

a set of first lower contacts including a first lower differential pairs having two first contacting sections, a second lower differential pairs having two second contacting sections and a grounding contact having two opposite grounding arms, and the first contacting sections, the second contacting sections and the two grounding arms arranged upon the second mating face in a longitudinal direction under a condition that the two first contacting sections are disposed between the two grounding arms, the two first contacting sections and the two second contacting sections are respectively disposed at two opposite sides of one of the grounding arms;

a second connector mated with the first connector and including:

a second insulative housing having a mating room;

a set of second upper contacts and a set of second lower contacts oppositely disposed at two sides of the mating portion, the set of second upper contacts each defining a first flexible contacting arm downwardly projecting into the mating room, and the set of second lower contacts each defining a second flexible contacting arm upwardly projecting into the mating room; and a second grounding plate retained in the second housing and disposed between the set of second upper contacts and the set of second lower contacts.

9. The electrical connector assembly as described in claim 8, wherein the first lower differential pairs each defines a first terminal portion connecting with the first contacting section, the second lower differential pairs each defines a second terminal portion connecting with the second contacting section, and the grounding contact defines a tail section connecting with the two grounding arms, and the first terminal portions are arranged in a first row, and the second terminal portions and the tail section are arranged in a second row.

10. The electrical connector assembly as described in claim 8, wherein the first connector further defines a first grounding plate retained in the first housing and disposed between the set of first upper contacts and the set of first lower contacts.

11. The electrical connector as described in claim 10, wherein the set of first upper contacts include an upper differential pairs and two upper grounding contacts located at two opposite sides of the upper differential pairs, the upper differential pairs each defines an upper contacting section, and the first grounding plate defines a first shielding arm disposed between the two grounding contacts in the longitudinal direction and between the upper contacting sections and the first contacting sections in the vertical direction.

12. The electrical connector assembly as described in claim 8, wherein the second housing defines a second base portion, first and second tongue portions oppositely extending forward from the second base portion, and the mating room is disposed between the first and second tongue portions.

13. The electrical connector assembly as described in claim 12, wherein each second upper contact defines a first fixing portion retained in the first tongue portion, each second lower contacts defines a second fixing portion retained in the second tongue portion, the second grounding plate is retained in the second base portion and disposed between the first fixing portions and the second fixing portions.

14. The electrical connector assembly as described in claim 12, wherein the second grounding plate defines a second base plate and five second shielding arms extending forward from a front end of the second base plate.

15. An electrical connector assembly comprising:

a printed circuit board;

a first connector mounted upon the printed circuit board, said connector including:

a first insulative housing defining an opening in a front-to-back direction;

a mating tongue assembled to the housing and extending through the opening and defining opposite first and second surfaces thereon;

a plurality of first contacts defining first contacting sections exposed upon the first surface and first mounting sections mounted to the printed circuit board;

a plurality of second contacts defining second contacting sections exposed upon the second surface and second mounting sections mounted to the printed circuit board;

a grounding plate located between the first contacting sections and second contacting sections and defining grounding mounting sections mounted to the printed circuit board; wherein the mating tongue is configured to have the first contacts assembled thereto in a direction parallel to said front-to-back direction while having the second contacts assembled thereto in a vertical direction perpendicular to said front-to-back direction.

16. The electrical connector assembly as claimed in claim 15, wherein the second contacts are designated with differential pairs and grounding contacts under condition that the second mounting sections of the grounding contacts share a same piece which is located behind those of the corresponding differential pairs sandwiched therebetween.

17. The electrical connector assembly as claimed in claim 16, wherein the first mounting sections are configured for surface mounting while the second mounting sections are configured for through hole mounting.

18. The electrical connector assembly as claimed in claim 16, wherein the second mounting sections of the grounding contacts share the same piece further located transversely aligned with those of other corresponding differential pairs sandwiched therebetween.

19. The electrical connector assembly as claimed in claim 16, further including a spacer integrally formed with the second contacts.

20. The electrical connector assembly as claimed in claim 19, wherein said spacer cooperates with the mating tongue to sandwich the grounding plate therebewteen.

* * * * *